US005868024A

United States Patent [19]

Codatto

[11] Patent Number: 5,868,024

[45] Date of Patent: Feb. 9, 1999

[54] BENDING PRESS FOR MAKING CHANNEL-SHAPED BENDS IN THE FOUR EDGES OF A SHEET-METAL PANEL

[76] Inventor: Antonio Codatto, Via Venezia 21, I-36045 Lonigo, (Vicenza), Italy

[21] Appl. No.: 817,721

[22] PCT Filed: Oct. 23, 1995

[86] PCT No.: PCT/EP95/04152

§ 371 Date: Jul. 11, 1997

§ 102(e) Date: Jul. 11, 1997

[87] PCT Pub. No.: WO96/13346

PCT Pub. Date: May 9, 1996

[30] Foreign Application Priority Data

Oct. 27, 1994 [IT] Italy ..... TO94A0864

[51] Int. Cl.[6] ..... B21D 5/04

[52] U.S. Cl. ..... 72/323; 72/478

[58] Field of Search ..... 72/319, 323, 446, 72/478, 452.9

[56] References Cited

U.S. PATENT DOCUMENTS

| | | |
|---|---|---|
| 4,089,198 | 5/1978 | Amano et al. . |
| 4,660,402 | 4/1987 | Hongo . |
| 4,722,214 | 2/1988 | Hayashi et al. . |
| 5,313,814 | 5/1994 | Yamamoto et al. . |

FOREIGN PATENT DOCUMENTS

| | | | |
|---|---|---|---|
| A-0298056 | 1/1989 | European Pat. Off. . | |
| 148021 | 9/1983 | Japan | 72/319 |
| 63-3710 | 1/1988 | Japan . | |
| 43723 | 2/1988 | Japan | 72/323 |
| 295018 | 12/1988 | Japan | 72/478 |
| 41020 | 2/1992 | Japan | 72/478 |

*Primary Examiner*—Daniel C. Crane

*Attorney, Agent, or Firm*—Blank Rome Comisky & McCauley LLP

[57] ABSTRACT

The bending press is of the type comprising a movable blank-holder formed by a series of sections in which two spaced-apart sections are in the form of shoes (34) with projections (36) pointing in opposite direction so that each can be engaged in a channel-shaped bend which has already been made. Each shoe (34) is supported by a shoe-holder body (38) by means of inclined guides (40) by virtue of which, when the movable blank-holder moves away from the fixed blank-holder, the two shoes (134) move towards one another in order to release their projection (36) from the channel-shaped bends. Each shoe (34) and the respective shoe-holder body (138) are interconnected by positive drive means (50, 54, 56, 58) for moving the shoe (34), the means being coordinated with drive means of the movable blank-holder so that the movements of the movable blank-holder away from and towards a fixed blank-holder associated therewith correspond to movements of the shoes (34) towards and away from each other, respectively, without sliding of the shoes on the sheet metal.

9 Claims, 6 Drawing Sheets

Figure 1:
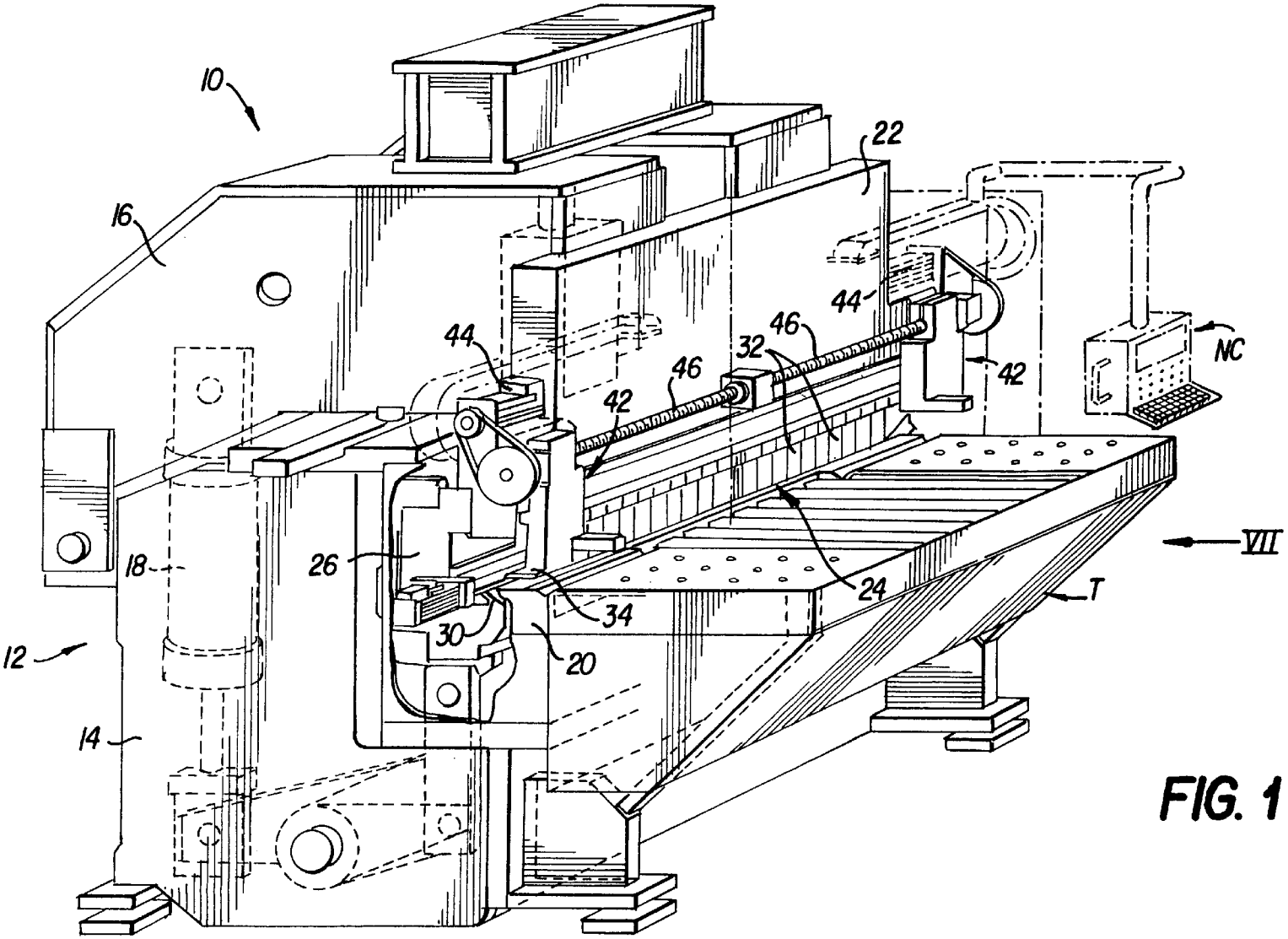

BENDING PRESS FOR MAKING CHANNEL-SHAPED BENDS IN THE FOUR EDGES OF A SHEET-METAL PANEL

This application is a 371 of PCT/EP95/04152, filed Oct. 23, 1995.

The present invention relates to a bending press for making channel-shaped bends in the four edges of a sheet-metal panel, of the type comprising a pair of opposed, movable and fixed blank-holders cooperating with respective bending blades, in which the movable blank-holder has drive means for its movements and is formed by a series of sections in which two spaced-apart sections are in the form of shoes with projections pointing in opposite directions so that each can be engaged in a channel-shaped bend which has already been made, and in which each shoe is supported by a shoe-holder body and each shoe and the respective shoe-holder body are interconnected by drive means for moving the shoe, such drive means being coordinated with the drive means of the movable blank-holder so that the movements of the movable blank holder away from and towards the fixed blank-holder correspond to movements of the shoes towards and away from one another, respectively, without sliding of the shoes on the sheet metal (P).

A bending press of this kind is known from the document U.S. Pat. No. 5,313,814.

This known arrangement is used in vertical bending presses in which the movable blank-holder is the upper one. In these bending presses, the presence of the movable or "contractible" inserts in the form of shoes is necessary for releasing the panel which has been bent on four sides from the press.

In the bending press known from the document U.S. Pat. No. 5,313,814 the shoe-holder bodies are pivoted in such a manner as to be able to oscillate towards and away from one another. The means for moving the shoe-holders and their shoes are constituted by fluid actuators. Each fluid actuator is connected on one side to the blank-holder and, on the other side, to the respective shoe-holder body through an articulated linkage.

The main object of the invention is to provide a bending press of the kind considered which allows to obtain a more reliable, rugged and accurate connection between the shoe-holder bodies and the movable blank-holder.

According to the invention this object is attained by a bending press of the kind considered, characterised in that:

- each shoe is supported by its respective shoe-holder body by means of inclined guides;
- the drive means for moving the shoes comprise, for each shoe, a rotary motor and a transmission mechanism for transforming the motion of the motor into a corresponding linear movement of the shoe along its respective inclined guide; and
- the transmission mechanism comprises a first set of teeth fixed to the carriage, an input shaft housed in the shoe-holder body and connected to the first set of teeth by a pinion, a second set of teeth fixed to the shoe, and gearing for transmitting the drive from the input shaft to the second set of teeth.

In known bending presses of the type in question, which have been used from about fifty years, but which are not disclosed in printed documents known to the present applicant, the two opposed shoes are simply slidable in oblique directions, for example at 45°, and their movements take place by the effect of gravity: when, upon completion of the bending, the upper blank-holder is raised relative to the lower fixed one, owing to their weight, the two shoes remain in contact with the sheet metal supported on the lower blank-holder and slide horizontally thereon to the position in which their projections no longer interfere with the channel-shaped bends in which they were engaged. The upward movement of the upper blank-holder can thus continue so that the panel bent on four sides can be removed from the press.

Moreover, when the upper blank-holder is moved downwards to pinch the panel in cooperation with the lower blank-holder for the formation of a bend, the shoes bear against the sheet metal and slide thereon whilst they are brought to the wide-apart position in which their projections are engaged in the lateral bends already made.

The sliding of the shoes on the sheet metal is undesirable since it may produce unsightly lines on the sheet metal.

As well as achieving the main object of providing a bending press in which the connection between the shoe-holder bodies and the movable blank-holder is more reliable, rugged and accurate than the arrangement of the document U.S. Pat. No. 5,313,814, the concept of the invention as claimed also permits the provision of bending presses other than those in which the movable blank-holder is the upper one and moves vertically, for example, such as presses in which the movable blank-holder is the lower one, or moves horizontally. This is due to the fact that, by virtue of their positive drive, the force of gravity is no longer used to bring about the movements of the shoes.

Figure 2:
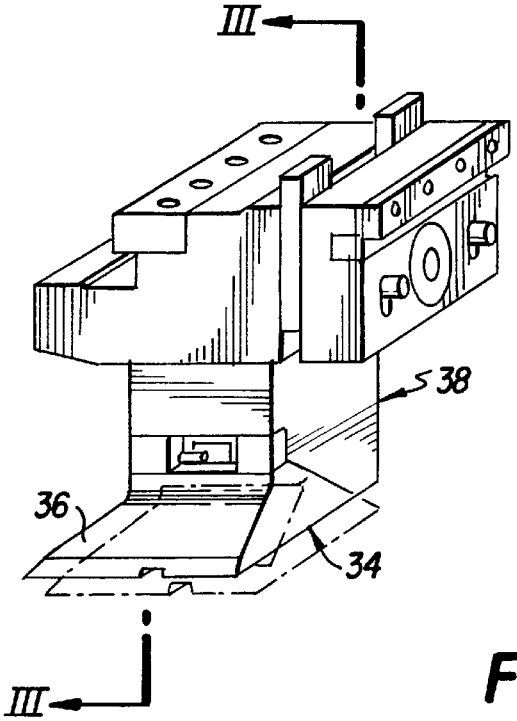
Figure 5:
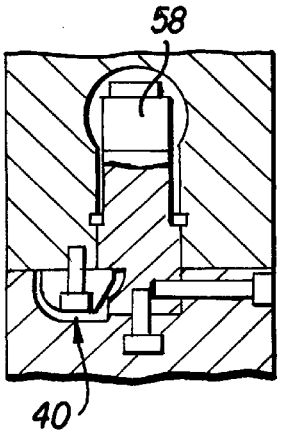
Figure 6:
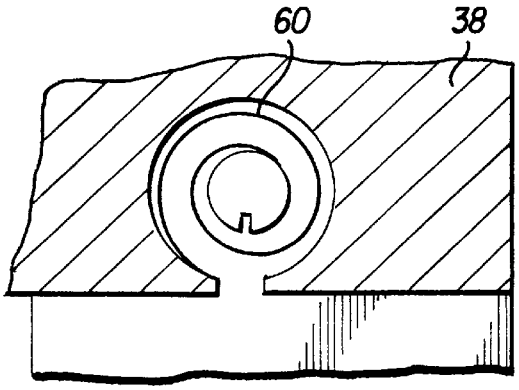
Figure 4:
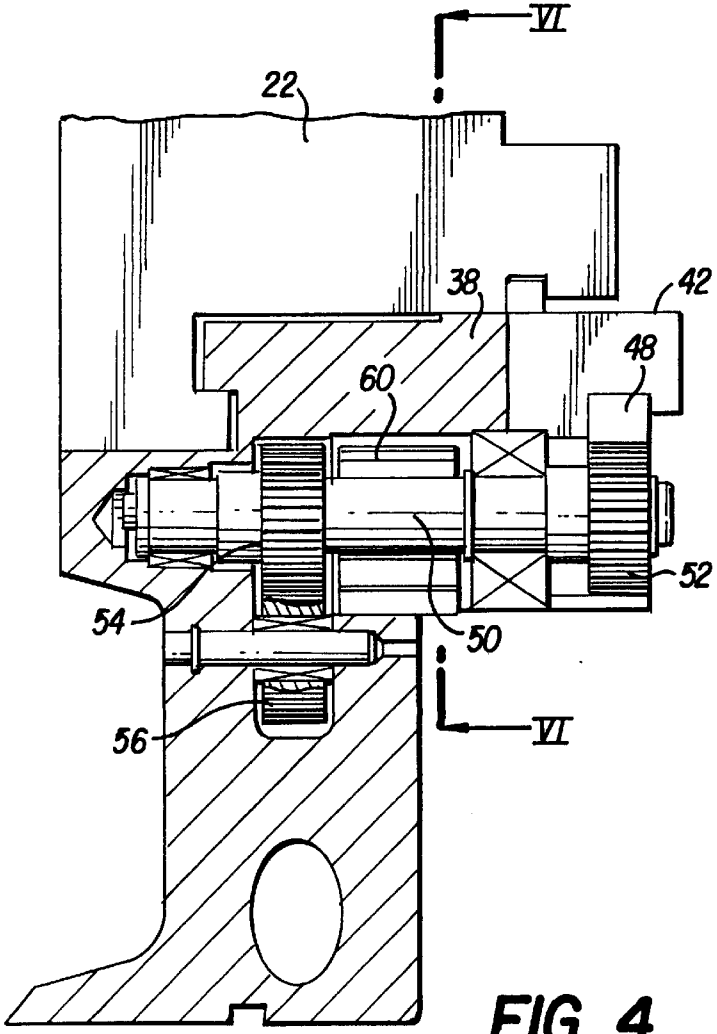
Figure 3:
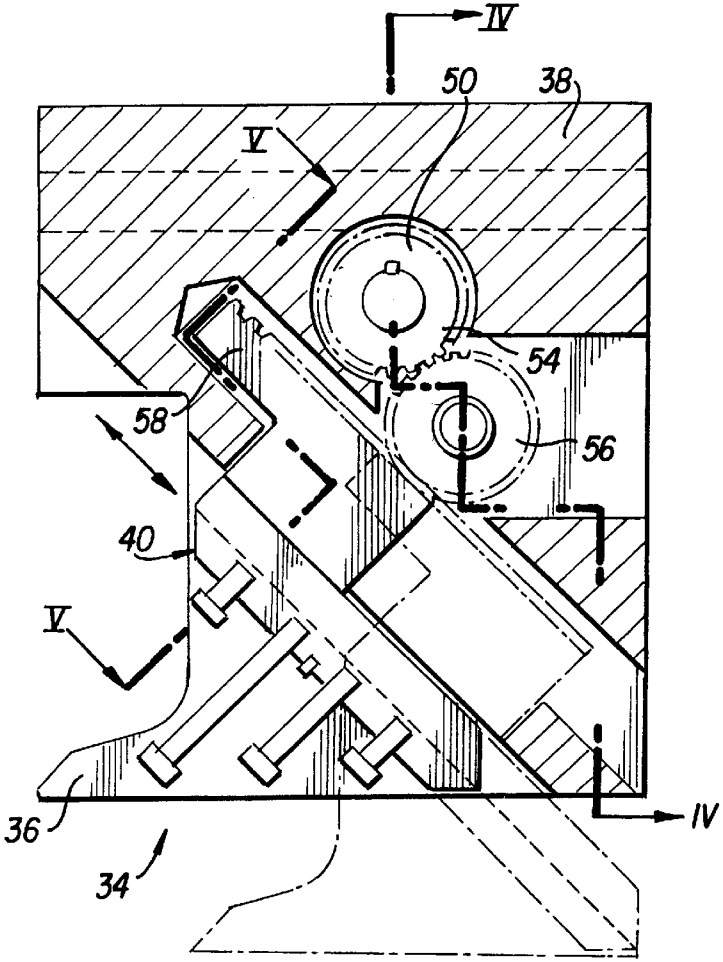

The invention will be understood better from a reading of the following detailed description given with reference to the appended drawings provided by way of non-limiting example, in which:

FIG. 1 is a perspective view of a bending press to which the invention is applied, FIG. 2 is a perspective view, on an enlarged scale, of an embodiment of one of the two shoe-shoe-holder units of the press of FIG. 1 (the left-hand unit nearest to the observer in FIG. 1, it being understood that the other shoe-shoe-holder unit is an identical mirror-image), FIG. 3 is a section through the unit of FIG. 2, taken in the plane III—III parallel to the bending line of the press, FIG. 4 is a hybrid transverse section taken on the broken line IV—IV of FIG. 3, FIG. 5 is a hybrid partial section taken on the line V—V of FIG. 3, FIG. 6 is a partial section taken in the vertical plane indicated VI—VI in FIG. 4, and FIGS. 7, 8 and 9 are schematic partial front views taken on the arrow VII of FIG. 1, showing three successive stages of the disengagement of the upper blank-holder of the press and of its shoes from a bent sheet-metal panel.

Figure 14:
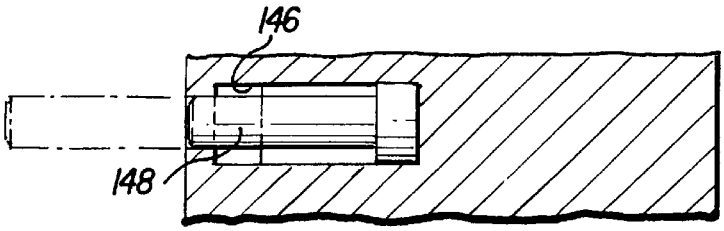
Figure 7:
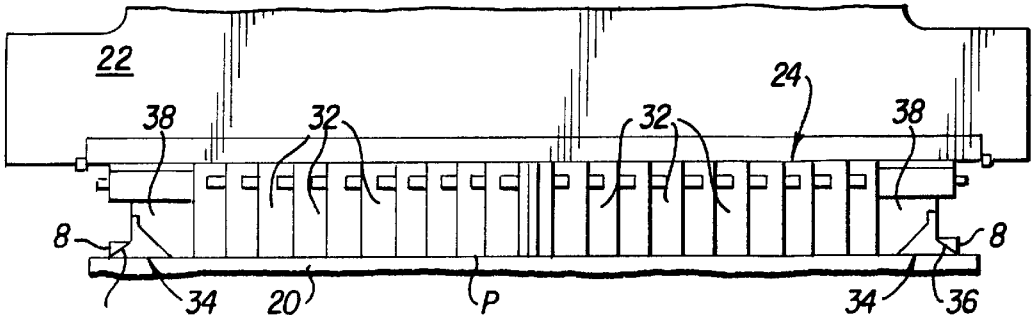
Figure 8:
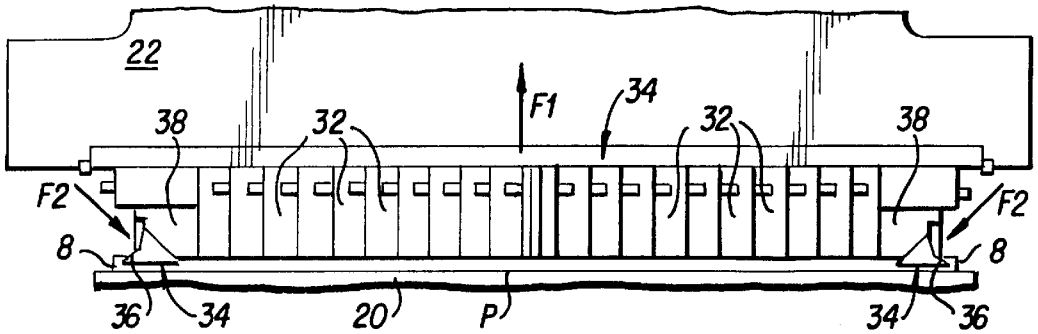
Figure 9:
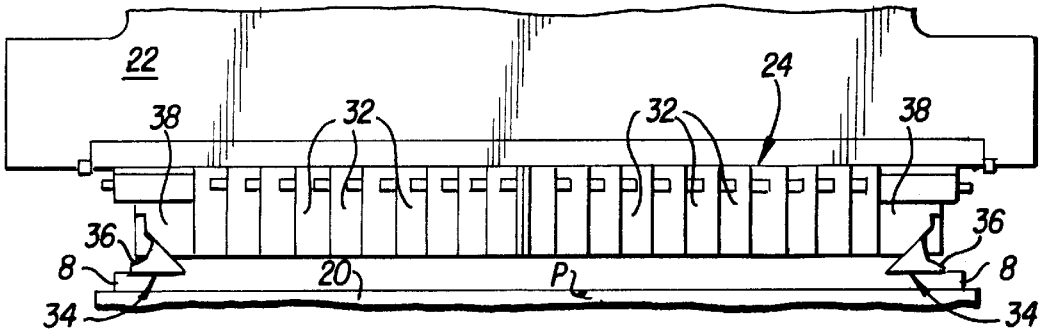
Figures 10, 13:
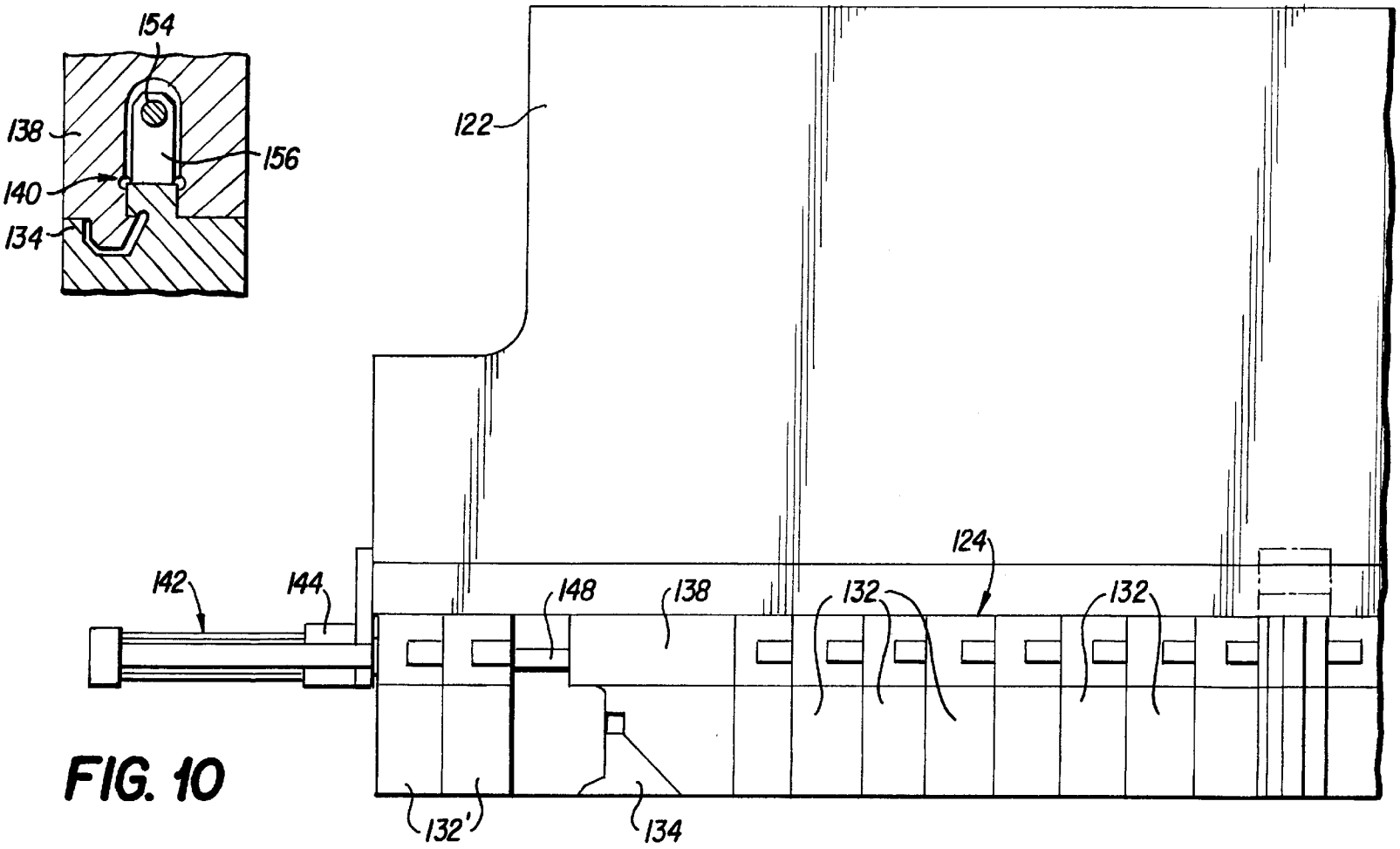
Figure 12:
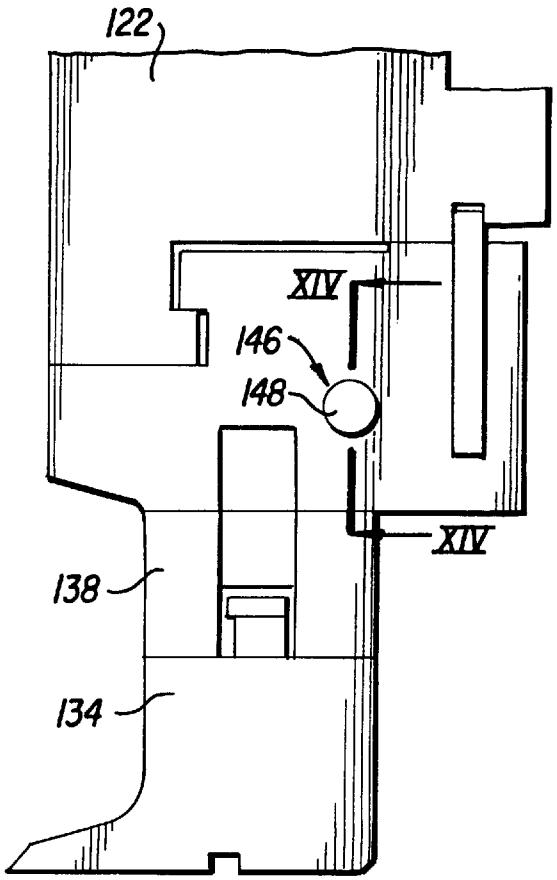
Figure 11:
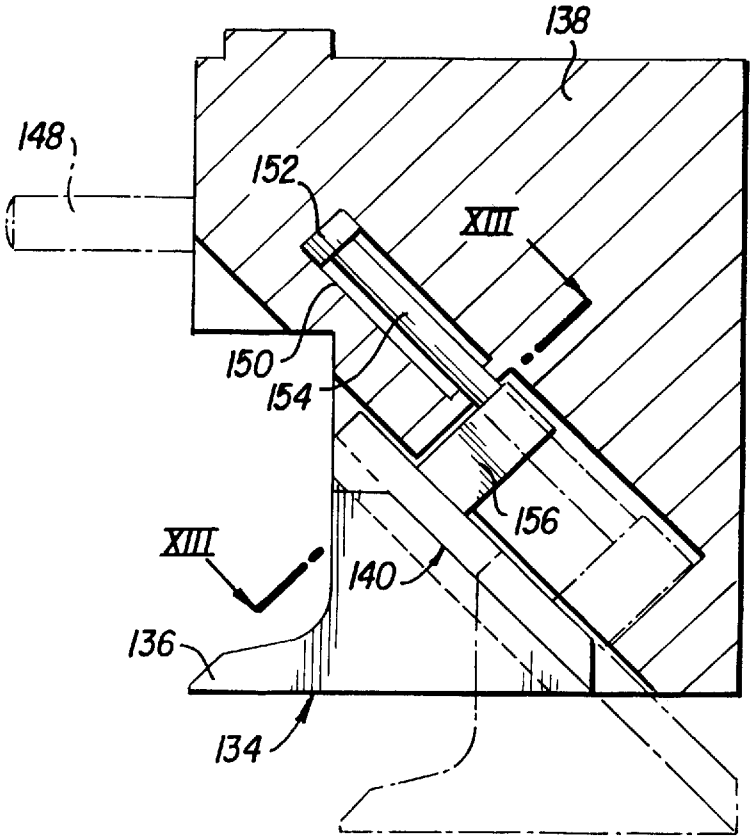

FIG. 10 is a front view similar to that of FIGS. 7 to 9, showing the left-hand half of an upper blank-holder of a different type, with a shoe-holder unit according to a variant of the invention, FIG. 11 is a section similar to that of FIG. 3 showing the internal structure of the shoe-shoe-holder unit of FIG. 10, FIG. 12 is a side view thereof taken on the arrow XII—XII of FIG. 11, FIG. 13 is a partial section taken in the plane indicated XIII—XIII in FIG. 11, and FIG. 14 a partial vertical section taken as indicated at XIV—XIV in FIG. 12.

With reference to FIG. 1, a vertical bending press, generally indicated 10, comprises a strong C-shaped framework, generally indicated 12.

The framework 12 in turn comprises a lower, fixed portion 14 and an upper, pivoting portion 16, the pivoting of which is brought about by one or more hydraulic actuators 18. The lower, fixed portion 14 supports a lower, fixed blank-holder 20.

The upper, pivoting portion 16 supports a strong front plate 22 which carries, at its lower end, a movable blank-holder 24 which will be described further below.

A blade-holder 26 which is also C-shaped, is mounted in the cavity defined by the C-shape of the framework 12. and carries a pair of upper and lower blades. The blade-holder 26 can be moved upwards and downwards under the control of a numerically-controlled motor 28 to cause selective cooperation of its lower blade, indicated 30, with the upper blank-holder 24, or of its upper blade (not visible in FIG. 1) with the lower blank-holder 20.

The arrangement described by way of example above, is that illustrated and described in detail in the document EP-A-0 298 056 to which reference should be made for further details.

The upper movable blank-holder 24 is of the sectional type formed by a series of sections 32, for example, as described in the bending press described and illustrated in the document U.S. Pat. No. 4,089,198. This sectional arrangement can best be seen in FIGS. 7, 8 and 9.

The series of sections comprises two special sections, indicated 34, which are spaced apart so as to correspond to opposite side edges of a sheet-metal panel. In FIGS. 1, 7, 8 and 9, these sections 34 are disposed at the two ends of the series of sections, that is, in positions corresponding to the maximum usable width of the press.

As shown in FIG. 1, on the front of the press 10 there is a table T, preferably served by a manipulator, not shown, for supporting a sheet-metal panel.

All of the movements of the press and of its manipulator are brought about by a numerical-control device, conventionally indicated NC, which also indicates its "console".

With reference now to FIGS. 2 and 3, each section 34 is in the form of a shoe with a beak-like projection 36.

As can be seen, for example, in FIG. 7, the projections 36 of one shoe 34 and of the other point in opposite directions so that each can be engaged in a lateral channel-shaped bend, indicated B, which has already been made in a sheet-metal panel P.

With reference again to FIG. 2 and 3, each shoe is supported by a shoe-holder body 38 connected to the front plate 22 of the upper movable portion 16 (FIG. 1) of the framework of the press.

Each shoe 34 is supported by its body 38 by means of inclined guides 40 which are oriented, for example, at 45°, and the dovetail configuration of which can be seen in FIG. 5.

The shoe 34 can be moved along the guides 40 between a working or engagement position, shown in continuous outline in FIGS. 2 and 3, and a release position, shown in chain line in the same drawings. According to the invention, this oblique movement of each shoe 34 is brought about positively in one of the ways which will be described by way of example below.

With reference again to FIG. 1 two carriages 42 movable on the front of the plate 22 and alone the movable blank-holder 24 serve, in known manner, to rearrange the sections 32, 34 under the control of the numerical control device NC.

The movements of each carriage 42 are brought about by a respective numerically-controlled motor 44 by means of a respective threaded bar 46.

In the embodiment of the shoe 34-shoe-holder 38 unit shown in FIGS. 3 to 6, the two carriages 42 are also arranged for bringing about the movements of the shoes 34 between their two working or engagement and release positions.

For this function, each carriage 42, shown partially in FIG. 4, has a first set of teeth 48 which extends parallel to its direction of movement.

An input shaft 50 (FIGS. 3 and 4), rotatable in the shoe-holder body 38, carries a first pinion 52 meshed with the teeth 48.

The shaft 50 also carries a second pinion 54 meshed with a third pinion 56 also rotatable in the body 38.

The pinion 56 is meshed with a second set of teeth 58 which extends along the oblique axis of sliding of the shoe 34 and is fixed to the shoe (FIGS. 3 and 5).

As will be understood, the movements of the shoe 34 of the embodiment of FIGS. 3 to 6 are brought about by a respective numerically-controlled motor 44, by means of a programmed translational travel of the respective carriage 42.

In this same embodiment, the mechanical transmission mechanism which includes the shaft 50, the pinions 52, 54 and 56 and the second set of teeth 58 preferably incorporates a resilient biasing member which returns the shoe 34 to the working position to which it is moved away from the other shoe, whereas the numerically-controlled motor 44 can bring about the movement of the shoe 34 to the release position to which it is moved towards the other shoe against the force of the biasing member.

As shown in FIGS. 4 and 6, the biasing member is preferably in the form of a spiral spring 60 interposed between the input shaft 50 and the shoe-holder body 38.

According to a variant, not shown, a transmission mechanism similar to that shown in FIGS. 3 and 4 could be driven by an individual numerically-controlled motor of the shoe-shoe-holder unit and not by the numerically-controlled motor which drives the respective carriage 42.

Reference will now be made to FIGS. 7, 8, and 9 in order to describe the coordinated sequence of movements of the movable blank-holder 24 and of its end shoes 34, both of which movements are brought about by the numerical control device NC of FIG. 1.

In FIG. 7, the sheet-metal panel P is pinched between the two lower and upper blank-holders 20 and 24. The two shoes 34 are in their respective working positions in which they have been moved apart and their projections 36 are engaged in the respective lateral bends B of the panel P.

With reference to FIG. 8, in order to be able to release the panel P from the press, the numerical control device brings about the upward movement of the plate 22 and of the movable blank-holder 24 in the direction indicated by the arrow $F_1$ and, at the same time, the oblique movement of the two shoes in the directions indicated by the arrows $F_2$ towards their release positions. The coordination of the movements is such that, as soon as the movable blank-holder 24 is separated from the panel P, the shoes 34 also start to move in the directions indicated by the arrows $F_2$ and are separated from the panel P so that they never slide on the panel.

FIG. 9 shows the final position in which the movable blank-holder 24 is raised and the shoes 34 are closest together having reached the final release position. In this position, the projections 36 no longer interfere with the bends B.

When the upper blank-holder 24 is lowered against a panel P for bending, the movements of the blank-holder 24 and of the shoes 34, which are coordinated by the numerical control device NC, take place in the opposite directions, again without sliding of the shoes 34 on the panel P.

FIGS. 10 to 13 show a variant of the shoe-shoe-holder unit applied to a bending press having a different system for rearranging the sections of the movable blank-holder.

The parts illustrated in FIGS. 10 to 14 which correspond to those of the preceding drawings will be indicated, as far as possible, by the same reference numerals, increased by 100.

In FIG. 10, the upper movable plate 122 of the press carries a movable blank-holder 124 which again comprises a series of sections 132 as well as a pair of sections each constituted by a shoe 134 with its shoe-holder 138.

Only the left-hand unit 134–138 is shown in FIG. 10, it being understood that the right-hand unit is an identical mirror-image.

The unit 134–138 is shown, by way of example, in a position which does not correspond to the maximum useful width of the press.

At each end of the series of sections, the plate 122 carries a hydraulic actuator or so-called packer cylinder 142 with a thrust rod 144 which, in cooperation with a homologous rod of the opposite packer cylinder, keeps the entire series of sections of the blank-holder 124 closely packed.

As is also shown in FIGS. 11, 12 and 14, the shoe-holder body 138 incorporates a so-called spacer cylinder 146 with a thrust rod 148 which, as indicated in FIG. 10, keeps the sections 132'-which are not being used during bending-away from the unit 134–138.

As shown in FIGS. 11 and 13, the shoe 134, the beak-like projection of which is indicated 136, is connected to the respective shoe-holder body 138 by means of dovetail guides, indicated 140, arranged obliquely, for example, at 45°. As in the embodiment of FIG. 3, the shoe 134 can thus slide along these guides between the working or engagement position shown in continuous outline and the release position shown in chain line in FIG. 11.

As shown in FIG. 11, a cylinder 150 Is formed in the shoe-holder body 138, with its axis parallel to that of the guides 140.

A piston 152, to which a rod 154 is fixed, is slidable in the cylinder. The rod is in turn fixed to a bracket 156 fixed rigidly to the shoe 134.

As will be understood, in the embodiment of FIGS. 10 to 13, the positive drive means for moving the shoe 134 are constituted by the hydraulic actuator which includes the cylinder 150. This actuator is in turn driven by the same hydraulic equipment which drives the movable blank-holder 124 in order to carry out the same sequence of movements as described with reference to FIGS. 7, 8 and 9, as well as the reverse sequence.

I claim:

1. A bending press for making channel-shaped bends in the four edges of a panel, comprising:

a pair of opposed, movable and fixed blank-holders;

a pair of bending blades provided behind the blank-holders, for cooperating with respective blank-holders;

a first drive device that moves the movable blank-holder; and the movable blank-holder having:

a series of sections, in which two spaced-apart sections are in the form of shoes with projections pointing in opposite directions, for engaging in a channel-shaped bend which has already been made;

a shoe-holder body for supporting each shoe by means of inclined guides; and a second drive device provided on each shoe-holder body, for moving the respective shoe, the second drive device being coordinated with the first drive means so that the movements of the movable blank-holder away from and towards the fixed blank-holder correspond to movements of the shoes towards and away from one another, respectively, without sliding of the shoes on the sheet metal, whereby, when the movable blank-holder moves away from the fixed blank-holder, the two shoes move towards one another in order to release their projections from the channel-shaped bends.

2. A press according to claim 1, further comprising a numerical control device for controlling the movements of the movable blank-holder, wherein the second drive device includes, for each shoe, a numerically-controlled motor controlled by the numerical control device, and a mechanical transmission for transforming the motion of the numerically controlled motor into a corresponding linear movement of the shoe.

3. A press according to claim 2, further comprising a pair of carriages movable along the movable blank-holder in order to rearrange the sections of the blank-holder under the control of the numerical control device, wherein the numerically-controlled motor is adapted to drive a respective carriage.

4. A press according to claim 2, further comprising a biasing member for biasing the shoe resiliently towards a working position to which it is moved away from the other shoe, wherein the numerically-controlled motor can move the shoe to the position to which it is moved towards the other shoe against the force of the biasing member.

5. A press according to claim 1, wherein the second drive device includes, for each shoe, a numerically-controlled motor, and a mechanical transmission for transforming the motion of the numerically controlled motor into a corresponding linear movement of the shoe, wherein the mechanical transmission mechanism comprises a carriage movable along the movable blank-holder a first set of teeth fixed to the carriage, an input shaft housed in the shoe-holder body and provided with a pinion coupled to the fist set of teeth, a second set of teeth fixed to the shoe and gearing for transmitting the drive from the input shaft to the second set of teeth.

6. A press according to claim 5, further comprising a resilient biasing member in the form of a spiral spring interposed between the input shaft and the shoe-holder.

7. A press according to claim 1, wherein the movable blank-holder is driven by hydraulic equipment, the second drive device for moving the shoes comprise, for each shoe, a hydraulic actuator with a piston rod fixed to the shoe, and the actuator is driven by the same hydraulic equipment which drives the movable blank-holder.

8. A press according to claim 3, further comprising a biasing member for biasing the shoe resiliently towards a working position to which it is moved away from the other shoe, wherein the numerically-controlled motor can move the shoe to the position to which it is moved towards the other shoe against the force of the biasing member.

9. A bending press for making channel-shaped bends in the four edges of a panel, comprising:

a pair of opposed, movable and fixed blank-holders;

a pair of bending blades provided behind the blank-holders, for cooperating with respective blank-holders;

a blank-holder drive system that moves the movable blank-holder; and the movable blank-holder having:

a series of sections, in which two spaced-apart sections are in the form of shoes with projections pointing in opposite directions, for engaging in a channel-shaped bend which has already been made;

a shoe-holder body for supporting each shoe by means of inclined guides; and a shoe drive member provided on each shoe-holder body so as to be movable relative to the shoe-holder body, the shoe drive member being engaged with a rear section of the shoe for moving the respective shoe, and the movement of the shoe drive member being coordinated with the blank-holder drive system so that the movements of the movable blank-holder away from and towards the fixed blank-holder correspond to movements of the shoes towards and away from one another, respectively, without sliding of the shoes on the sheet metal, whereby, when the movable blank-holder moves away from the fixed blank-holder, the two shoes move towards one another in order to release their projections from the channel-shaped bends.

* * * * *